US007752776B2

(12) United States Patent
Farnworth

(10) Patent No.: US 7,752,776 B2
(45) Date of Patent: Jul. 13, 2010

(54) THERMALLY INSULATING PRODUCTS FOR FOOTWEAR AND OTHER APPAREL

(75) Inventor: Brian Farnworth, Elkton, MD (US)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

(21) Appl. No.: 10/760,141

(22) Filed: Jan. 16, 2004

(65) Prior Publication Data

US 2004/0209061 A1 Oct. 21, 2004

Related U.S. Application Data

(63) Continuation-in-part of application No. 10/207,626, filed on Jul. 29, 2002, now abandoned.

(51) Int. Cl.
*A43B 5/00* (2006.01)
*A62B 17/00* (2006.01)

(52) U.S. Cl. ..... 36/83; 2/458; 428/35.2

(58) Field of Classification Search ..... 428/71, 428/76, 74; 36/71
See application file for complete search history.

(56) References Cited

U.S. PATENT DOCUMENTS

| | | | | | |
|---|---|---|---|---|---|
| 3,373,512 | A | * | 3/1968 | Jacobson | 36/7.1 R |
| 3,625,896 | A | | 12/1971 | Kirk | 252/62 |
| 3,869,334 | A | | 3/1975 | Hughes et al. | 161/87 |
| 3,925,916 | A | * | 12/1975 | Garbuio | 36/71 |
| 3,962,014 | A | | 6/1976 | Hughes et al. | 156/276 |
| 4,005,532 | A | * | 2/1977 | Giese et al. | 36/44 |
| 4,055,699 | A | | 10/1977 | Hsiung | 428/311 |
| 4,159,359 | A | | 6/1979 | Pelloux-Gervais et al. | 428/76 |
| 4,460,645 | A | | 7/1984 | Jones et al. | |
| 4,535,016 | A | * | 8/1985 | Bradley | 428/74 |
| 4,564,547 | A | | 1/1986 | Hughes | 428/117 |
| 4,636,416 | A | | 1/1987 | Kratel et al. | 428/69 |
| 4,729,179 | A | | 3/1988 | Quist, Jr. | 36/44 |
| 4,813,160 | A | | 3/1989 | Kuznetz | 36/3 R |
| 4,887,368 | A | | 12/1989 | Latzke | |
| 4,921,894 | A | | 5/1990 | Shumate | 524/377 |
| 5,376,449 | A | | 12/1994 | Harris et al. | 428/402 |
| 5,480,696 | A | | 1/1996 | Harris et al. | 428/69 |
| 5,584,130 | A | | 12/1996 | Perron | 36/44 |
| 5,637,389 | A | | 6/1997 | Colvin et al. | 428/308.4 |
| 5,691,392 | A | * | 11/1997 | Okoroafor et al. | 521/112 |
| 5,851,458 | A | | 12/1998 | De Vos et al. | 264/46.5 |
| 5,877,100 | A | | 3/1999 | Smith et al. | 501/12 |
| 5,973,015 | A | | 10/1999 | Coronado et al. | 521/64 |
| 6,010,762 | A | | 1/2000 | Smith et al. | |
| 6,045,718 | A | * | 4/2000 | Holman et al. | 252/62 |
| 6,068,882 | A | | 5/2000 | Ryu | 27/246 |
| 6,101,762 | A | | 8/2000 | Courtabessis et al. | 428/69 |
| 6,120,531 | A | | 9/2000 | Zhou et al. | |
| 6,121,336 | A | | 9/2000 | Okoroafor et al. | 521/112 |
| 6,132,837 | A | | 10/2000 | Boes et al. | 428/69 |
| 6,185,845 | B1 | | 2/2001 | Gordon | 36/7.1 R |
| 6,221,456 | B1 | | 4/2001 | Pogorski et al. | 428/69 |

FOREIGN PATENT DOCUMENTS

| | | |
|---|---|---|
| DE | 19512499 C1 | 6/1960 |
| EP | 0 032 176 B2 | 4/1992 |
| EP | 00736267 A2 | 10/1996 |
| JP | 2-38385 | 2/1990 |
| WO | WO 97/01972 | 1/1977 |

OTHER PUBLICATIONS

The Critical Properties and Acentric Factor Table, 1 page.

* cited by examiner

*Primary Examiner*—Callie E Shosho
*Assistant Examiner*—Anish Desai
(74) *Attorney, Agent, or Firm*—Dianne Burkhard

(57) ABSTRACT

Articles of apparel comprising insulating components having insulating structures with low thermal conductivity. Preferred insulating components for use in apparel have an insulating structure comprising a gas impermeable envelope and a porous material contained within the envelope where the insulating structure has a thermal conductivity of less than or equal to 25 mW/m K.

21 Claims, 4 Drawing Sheets

Figure 4. Average Toe Temperatures in Ski Boots
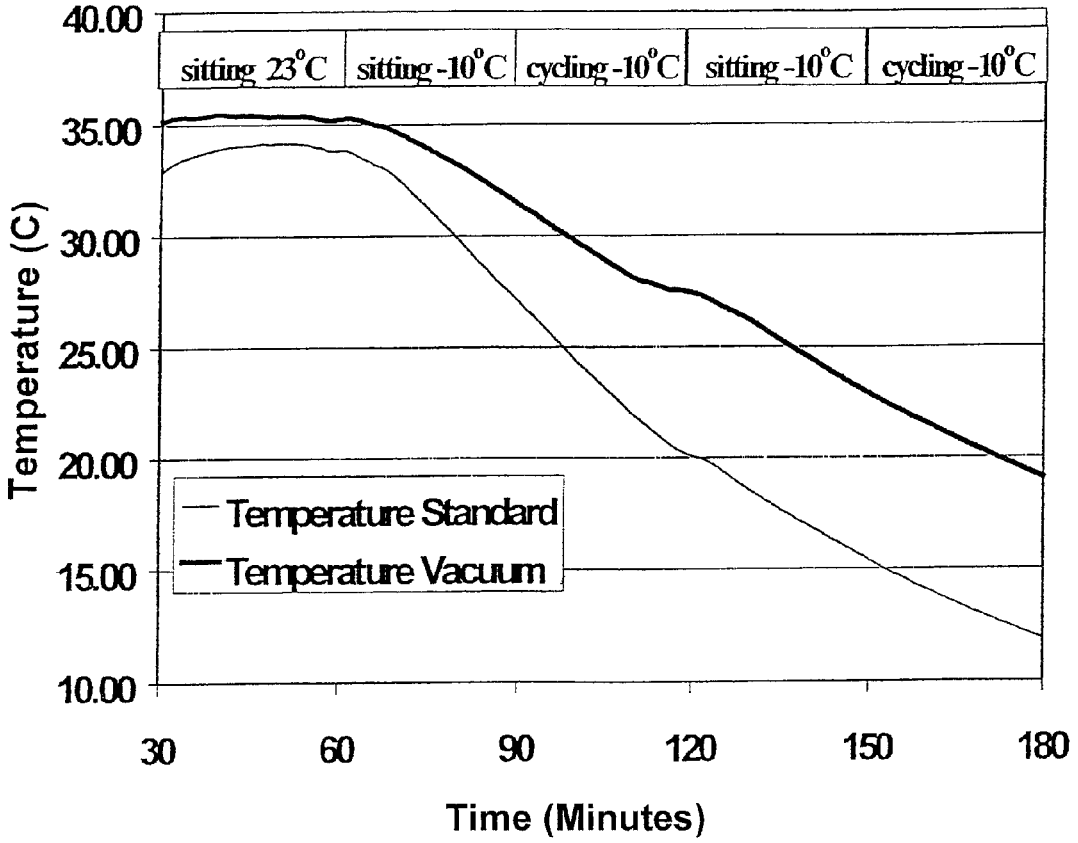

THERMALLY INSULATING PRODUCTS FOR FOOTWEAR AND OTHER APPAREL

The present invention is a continuation-in-part of U.S. patent application Ser. No. 10/207,626, filed Jul. 29, 2002, now abandoned. The present invention is directed to apparel having insulating material with low thermal conductivity. Apparel, as described in the present invention, is intended to include articles such as foot, hand and head wear, as well as body coverings such as jackets, coats and the like.

BACKGROUND

Use of thermal insulation in apparel is well known, with conventional materials consisting of batting, foam, down and the like. By way of example, insulation for footwear is known to include leather, felt, fleece, cork, flannel, foam and combinations thereof. A disadvantage of conventional insulating materials is that the achievement of high levels of insulation requires the use of a relatively large thickness of material. For example, adequate insulation in footwear for sub-freezing temperatures is several centimeters thick. In many applications, the provision of a large thickness of material is impractical especially in apparel items for work or sport. In these activities, there often exists requirements of dexterity in the hands, surefootedness and firm traction for the feet, firm control of skis, skates or snowboards, or a reasonably close and firm fit for helmets. Too great a thickness of insulation introduces the possibility of relative motion between the body and the item being worn and hence an insecure contact with the ground or objects that must be handled. The esthetics of an article may also be affected by added thickness and users may be averse to wearing bulky items of apparel which have an unflattering or unfashionable appearance.

U.S. Pat. No. 4,055,699, to Hsiung teaches a multi-layer insole for an article of footwear to insulate the foot from cold which is sufficiently thin to insulate without changing fit. The insole is a multi-layered laminate having a thin soft fabric layer laminated to the top of an open cell foam layer, a dense cross-linked polyolefin layer laminated to the foam layer, and an aluminum coated barrier layer of polymeric material laminated to the bottom of the cross-linked polyolefin layer. It is taught, however, that the insole is compressible and the open celled layer tends to pump air as body pressure is alternately applied, circulating warm air around the side of the foot within the shoe. Additionally, to increase insulation it is taught to increasing the thickness of the open-celled layer.

U.S. Pat. No. 4,535,016, to Bradley teaches an insulating material for articles such as jackets, trousers sleeping bags, and the like. The insulation material includes a sealed envelope that is permeable to gas and which is made of a tightly woven or knitted material. The envelope is filled with a fine fibrous insulating material such as goose down, and between 3% to 50% by weight of a finely divided hydrophobic particulate metal or metalloid oxide pigment in an amount in excess of that required to cover all surfaces of the insulating material. The pigment material is added to increase insulating power and water repellency when compared to uncoated fibrous insulating material.

The thermal conductivity of conventional insulation material for apparel is generally greater than that of air which has a thermal conductivity of about 25 mW/m K at 25° C. In the case of high density materials such as neoprene foam, high conductivity may result from conduction by the solid component, or in materials of intermediate density a combination of both mechanisms may result in higher conductivity. Conventionally, to substantially increase the level of insulation, a substantial increase in insulation material is added, which has the above-stated disadvantages such as changing the fit of an article.

Insulation materials having lower thermal conductivities are known for use in the building sector, storage and transport equipment such as refrigerated transporters and trucks, appliances such as high temperature ovens and furnaces, containers for storage of liquids and gases, and the like. For example, powder-in-vacuum insulation is known, where panels of particulate material are contained in an impermeable cover or film under an internal pressure below atmospheric pressure.

U.S. Pat. No. 5,877,100, to Smith et al. teaches compositions with low thermal conductivity for use in insulation panels. The composite is a particulate composition which under 15 psi load at 20° C. and at a pressure within the range of 133.3-13332.2 Pa in nitrogen, has a packing density of less than or equal to 160 kg/m$^3$, and a thermal conductivity of 4 to 6 mW/m K.

U.S. Pat. No. 4,159,359, to Pelloux-Gervais et al. teaches insulating materials used in buildings, refrigerators, ovens and furnaces. The insulating material is formed of a compacted structure having a low thermal conductivity. The compacted structure is formed of a fine silica-based, 100 angstrom particles, obtained by the heat treatment of a silane compound, which is compacted mechanically. At atmospheric pressure, the compacted structure is reported to have about twice the insulating performance of organic foams.

European Patent Publication No. 0 032 176 B2 to Degussa A G, teaches heat insulation mixtures that exhibit the least possible shrinkage at temperatures above 950° C. to minimize loss of heat-insulating properties. Insulation mixtures are compressed into boards, surrounded by porous enclosures and used for heat insulation of heat storage furnaces, decks and heating hoods. The heat insulation mixtures comprise pyrogenic silica, opacifier, inorganic fiber, and organosilicon compounds. While some low thermal conductivity insulation materials have enhanced insulation values, the utility of these materials is limited. Typically configured as large blocks or panels suitable for the above mentioned uses, the structures are thick and lack pliability.

Japanese Unexamined Patent Application No. 2-38385 teaches pliable insulating materials that may be used in non-planar arrangements, having low thermal conductivity. The insulating material comprises a pliable base material with open cells filled with fine particulate. The pliability of the open-celled material is taught to be unaffected by the fine particulate material which is formed by an anti-agglomeration treatment to ensure small void size within the cells. To avoid spillage of the particulate, the open-celled material may be covered with porous paper or air permeable film. It is taught that hermetic sealing of the insulating material would adversely affect pliability, and cause damage to the insulating material due to expansion of internal air from increase in temperature.

There is a need for articles of apparel having insulating components that provide greater insulation than conventional insulating materials, and which can be incorporated into apparel without substantially changing fit or appearance. Advantageously, such insulating components would be incompressible, having a lower thermal conductivity than conventionally used materials, and remain sufficiently pliable to meet the requirements of various apparel applications. The present invention is, therefore, directed to articles of apparel having insulating components which have substantially incompressible insulating structures and which have lower thermal conductivity than that of conventional insulating materials. The articles of apparel have pliable, flexible insulating structures that provide enhanced insulation without the addition of thick layers of insulating materials which disadvantageously affect the fit or functionality of the design of the article.

SUMMARY

The present invention is directed to articles of apparel comprising insulating components having an insulating structure with a low thermal conductivity. The thermal conductivity of the insulating structure is less than or equal to air, or i.e., less than or equal to about 25 mW/m K at 25° C.

Insulating structures comprise a gas impermeable envelope and structure material contained therein. Preferred structure materials comprise very fine porous materials, such as fumed silica, and optional other components such as binders and opacifiers. Preferred insulating structures comprise structure material of very fine pore sizes where the mean free path of a gas molecule, such as air, is larger than the dimensions of the pore. The mobility of the air molecule is limited, and thermal conductivity is thereby reduced.

The gas impermeable envelope may be sealed at atmospheric pressure, or alternately, the envelope may be evacuated of air and sealed at reduced pressure to further decrease the thermal conductivity. Preferred insulating structures at reduced pressure may have thermal conductivities of about 2 mW/m K to about 8 mW/m K. In another embodiment, the envelope may be at least partially evacuated of air and a gas having a higher molecular weight is introduced, prior to sealing the envelope. In one embodiment, a method of forming incompressible insulating structures comprises compressing the structure material as a processing step. Incompressible structures maintain flexibility, and lower the thermal conductivity of the insulating structure.

Insulating structures may be formed into any shape depending on the final end use of the structure. Further, insulating structures may be combined with conventional materials or insulating structures of the present invention to form insulating components. Articles of the present invention preferably comprise articles of apparel having insulating components comprising insulating structures with low thermal conductivities, such as boots, shoes, gloves, handwear, headwear, jackets, and the like.

BRIEF DESCRIPTION OF THE DRAWINGS

FIG. 4 is a graph of the average toe temperature in ski boots.

DETAILED DESCRIPTION

The present invention is directed to articles of apparel comprising insulating components having an insulating structure which have a low thermal conductivity. The present invention is further directed to a method of insulating articles of apparel and a method of providing insulation to a wearer of an article of apparel by incorporating low thermal conductive insulating components into an article of apparel and positioning the insulating component between a wearer and environment. Preferred embodiments of the present invention can best be described with reference to the exemplary embodiment depicted in FIG. 1.

Figure 1:
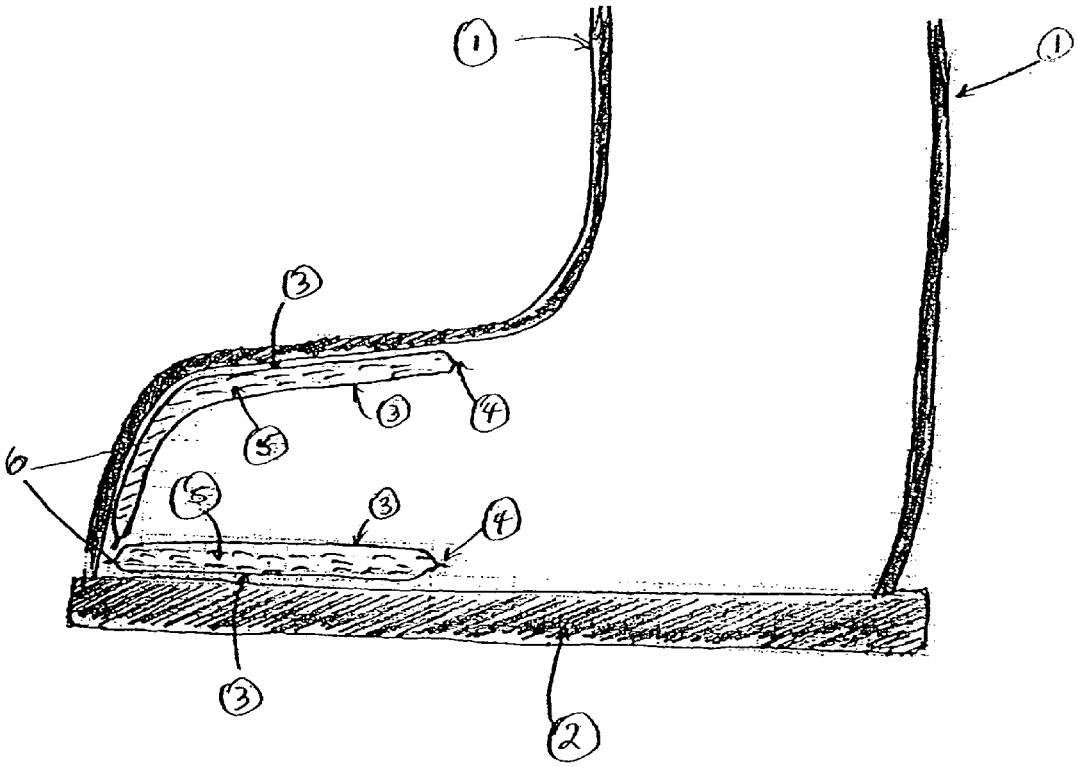
FIG. 1 is a side view cross section of a boot of the present invention.

FIG. 1 illustrates a preferred embodiment of a boot, shown as a cross-sectional view of a boot having a boot upper 1 and a boot sole 2, positioned within which is a toe cap insulating structure 6 having an envelope 3 sealed along its perimeter 4 enclosed within which is a fine porous material 5. A method of insulating a boot comprises providing a boot having a toe cap area, a boot upper and a boot sole, providing an insulating component to one or more of the toe cap area, the boot upper and sole, wherein the insulating component comprises an insulating structure according to the present invention, wherein the insulating component is positioned in any way known to insulate a boot, such as between inner and outer boot layers, or positioned on or affixed to the inner layer and located adjacent the wearer of a boot.

The insulating structure comprises structure material having a fine pore size. Pore size of preferred structure material is about 100 nm or less, and most preferably about 20 nm or less. Structure materials with fine pore sizes suitable for use in the present invention include fumed silica and alumina, and other fumed metal oxides, and aerogels of silica and other metal oxides.

In addition to the very fine porous material, structure material may further comprise a blend of other optional components including but not limited to binders, opacifiers, and the like. Fibers such as inorganic and organic fibers may be added, for example, as a binder to bind fine porous material. Preferred fibers are comprised of polyester, nylon, and glass. Particulate components including carbon, such as carbon black, and titanium dioxide may be added as opacifiers, which are opaque in the far infrared region of the electromagnetic spectrum, and serve to reduce heat transport by thermal radiation. Preferred are structure materials comprising a mixture of very fine porous material, binders and opacifiers. It is preferred that the very fine porous material comprises at least about 50% of the mixture. A preferred structure material comprises a mixture of 50% to 100% very fine porous material, such as fumed silica, 0 to 50% binder, such as polyester, nylon or glass fiber, and 0 to 20% of a particulate material, such as carbon black.

The structure material is contained in an envelope suitable to prevent the release of the fine porous material and the optional other components. Most preferably the envelope is a gas impermeable envelope, and the envelope preferably comprises at least one layer of material such as polyester, nylon, aluminum, polyethylene, and laminates and combinations thereof. The envelope preferably has a gas permeability of less than or equal to about $10^{-3}$ g/m$^2$ atmosphere/day and more preferably about $10^{-4}$ g/m$^2$ atmosphere/day. Gas impermeable envelopes comprising a reflective material, such as metallized polyester, aluminum or noble metals may be used to reduce radiative heat loss in preferred embodiments which do not contain opacifiers. A seal is formed encapsulating the fine porous material and optional additional components within the gas impermeable membrane. Sealing may be formed by any known method such as with adhesives, heat sealing, radiative frequency welding, ultrasonic welding, and the like.

The resulting insulating structure has a thermal conductivity less than or equal to air, or less than or equal to about 25 mW/m K at 25° C., more preferably, less than or equal to about 15-20 mW/m K at 25° C., and most preferably between about 15-18 mW/m K at 25° C.

To form an insulating structure of the present invention, a mold is provided, having a desired shape. In one preferred method, a mixture comprising very fine porous material and optional additional components is pressed in a flat press into an incompressible form having a density of about 150 kg/m$^3$. The form is cut to shape and the shape is placed within the mold between sections of a gas impermeable material. In a preferred embodiment a heat sealer is provided as a heated bar in the approximate shape of the perimeter of the mold, and pressed onto the envelope outside the perimeter of the shape to form a seal (FIG. 1, at 4). The preferred sealed insulating structure is incompressible, and is suitable for use in footwear and other articles of apparel that may be subject to pressure. Incompressible insulating structures maintain insulating properties where many conventional materials compress and lose much of their insulation value. Preferred insulating structures of the present invention are substantially incompressible under the weight of a human body. Insulating structures having a loss of thickness of 20% or less at a pressure of one atmosphere are considered substantially incompressible and are preferred. Structures with a loss of thickness of about 10% or less are particularly preferred, and about 5% or less are most preferred.

Where it is desirable to avoid altering the fit and design of the article of apparel, and to maintain pliability and flexibility, preferred insulating structures are used which have a thickness of about 10 mm or less, most preferably about 3 mm or less and more preferably about 2 mm or less. Thus, a preferred method of forming an insulated an article of apparel comprises a method of insulating an article of apparel without altering fit. A suitable method comprises providing an insulating component comprising an insulating structure according to the present invention preferably having a thickness of about 3 mm or less, and incorporating the insulating component into an the article of apparel. For example, where the article of apparel is a work boot or ski boot, it is desirable that insulation has a thickness of about 3 mm or less. Thicker insulating structures may be used in applications, for example, where flexibility is less critical such as liners of protective helmets. Insulating structures having a thickness of up to or greater than about 10 mm can be used where there is a substantial gap between the apparel item and the body. An insulating structure having a thickness of about 2 mm to about 10 mm, has a thermal insulation value of about 0.3 to 1.7 m$^2$ K/W. Thermal insulation can be calculated as the thickness of the insulating structure divided by the thermal conductivity of the structure, or i.e., m$^2$K=m/(W/m K). Thus, a further preferred method comprises a method of increasing the thermal insulation value of an article of apparel without substantially changing the fit of the article comprising providing an article of apparel, providing a insulating component comprising a gas permeable envelope and a fine porous material, wherein the insulating structure has a thickness of about 3 mm or less and comprises a thermal conductivity of preferably less than or equal to about 25 mW/m K at 25° C., and incorporating the insulating component into the article of apparel.

The pliable nature of the insulating structure provides that the structure may be further shaped to achieve a final form. The structure material may be provided as a continuous compressed body contained within the envelope. Alternately, to provide additional flexibility insulating structures may comprise one or more sections of the structure material within an envelope. The envelope may optionally be sealed, such as through heat sealing, between sections of the structure material thereby providing a quilted or patterned construction, additionally contributing to the flexibility and pliability of the article.

The final shape of the insulating structure depends upon the end use of the article. The insulating structure may be formed as a flat component, for utility as a sole of a shoe or boot, or may be shaped or curved for use as a toe cap or in head wear or gloves, or otherwise shaped to meet the requirements of the user. Insulating structures may be combined with traditional insulating materials or with additional insulating structures of the present invention to form insulating components useful in articles of apparel. Therefore, the insulating components of the present invention may be incorporated into articles of apparel such as boots, shoes, gloves, handwear, headwear, jackets, and the like, by any known method in any known configuration for incorporating insulating components into apparel.

One embodiment of the present invention is directed to an article comprising an article of apparel having one or more textile layers, such as inner and outer textile layers, and an insulating component or structure of the present invention incorporated into the article. The insulating component may be positioned on a textile layer on a side which is proximal or distal to the wearer, or between multiple textile layers of an article of apparel. Thus, a method of assembling an insulated article of apparel is described herein. The method comprises the steps of providing an article of apparel having at least one textile layer, providing an insulating component comprising an insulating structure wherein the insulating structure formed by the steps comprising placing a porous material in a gas impermeable envelope, wherein the insulating component has a thermal conductivity of preferably less than or equal to about 25 mW/m K at 25° C., and incorporating the insulating structure, such as by affixing or positioning, into the article, between or adjacent at least one textile layer. For example, the insulating component may be affixed to or positioned adjacent to the inner or outer textile layers.

Where the article already comprises an insulating component, the insulating structure may be affixed to the existing insulation or positioned adjacent the insulation. In one embodiment, an article of apparel comprises an insulating component incorporated into the article of apparel wherein the improvement comprises an insulating structure comprising a) a gas impermeable envelope and b) a porous material contained within the envelope, wherein the insulating structure has a thermal conductivity of preferably less than or equal to 25 mW/m K at 25° C.

Further, a method is disclosed for insulating a person from environmental conditions comprising providing an insulated article of apparel between a person and the environment, such as a low temperature environment, wherein the article of apparel comprises an insulating component incorporated therein, wherein the insulating component comprises an insulating structure comprising a gas impermeable envelope and a porous material contained within the envelope, and wherein the insulating structure has a thermal conductivity of preferably less than or equal to about 25 mW/m K at about 25° C.

A further embodiment of the present invention comprises articles of apparel having an insulating component with insulating structures wherein the structure has low thermal conductivity and in which air is encapsulated at reduced pressure. An insulating structure is formed, as described above, having a structure comprising a gas impermeable envelope, within which is fine porous material and optional other components, wherein the envelope is at least partially evacuated of air, and the envelope is sealed at reduced pressure by any suitable method. In a preferred embodiment, a method comprises providing a mold having an envelope and fine porous material with other optional components contained therein, placing the mold and a heat sealer in a vacuum chamber, evacuating the air to a reduced pressure, and heat sealing the envelope.

The pressure to which the insulating structure is evacuated may depend upon the pore size of the porous material. For example, a pressure of up to about 10,000 Pa may be used for structure material with pore sizes of about 100 nanometers or less. Preferably, the envelope is under a vacuum pressure of about 1000 Pa or less; most preferably the envelope is under a vacuum pressure of about 100 Pa or less. The gas impermeable envelope is sealed to maintain evacuation and reduced pressure.

Preferred insulating components have insulating structures with reduced pressure have even lower thermal conductivities than the preferred structures described above. Thermal conductivities of preferred insulating structures at reduced pressure are less than or equal to about 15 mW/m K, with reduced pressure insulating structures having thermal conductivities of about 2 to about 10 mW/m K being particularly preferred, and reduced pressure insulating structures having thermal conductivities of about 2 mW/m K to about 8 mW/m K being most preferred.

A further embodiment of the present invention comprises apparel having an insulating component which has an insulating structure comprising a fine pore size material and optional other components, as described above, and in which the insulating structure encapsulates gases having a molecular weight higher than that of air. Preferred gases have a molecular weight of about 100 or greater, and a boiling point of about 25° C. or less. High molecular weight gases suitable for use in the present invention include but are not limited to carbon dioxide, fluorocarbons, chlorocarbons, chlorofluorocarbons and hydrochlorofluorocarbons. Examples include, heptafluoro-1-nitrosopropane and 1,1,1,2,2,3-hexafluoropropane.

Preferred insulating components that have insulating structures encapsulating high molecular weight gas, have thermal conductivities of about 10 mW/m K to about 25 mW/m K. Particularly preferred high molecular weight, gas-encapsulated insulating structures have thermal conductivities of about 10 mW/m K to about 20 mW/m K, and most preferred high molecular weight, gas-encapsulated insulating structures have thermal conductivities of about 10 mW/m K to about 15 mW/m K.

A preferred method of forming an insulating structure comprises providing a structure material, providing a gas impermeable envelope to the structure material, evacuating air from the gas impermeable envelope as described above, and filling the vacuum chamber with a high molecular weight gas, and sealing the envelope.

Articles of the present invention preferably comprise articles of apparel having insulating components with low thermal conductivities, such as boots, shoes, gloves, handwear, headwear, jackets, and the like.

EXAMPLES

Example 1

The insulation value of the toe area of a ski boot was substantially increased without substantially altering the fit of the boot.

Figure 2A:
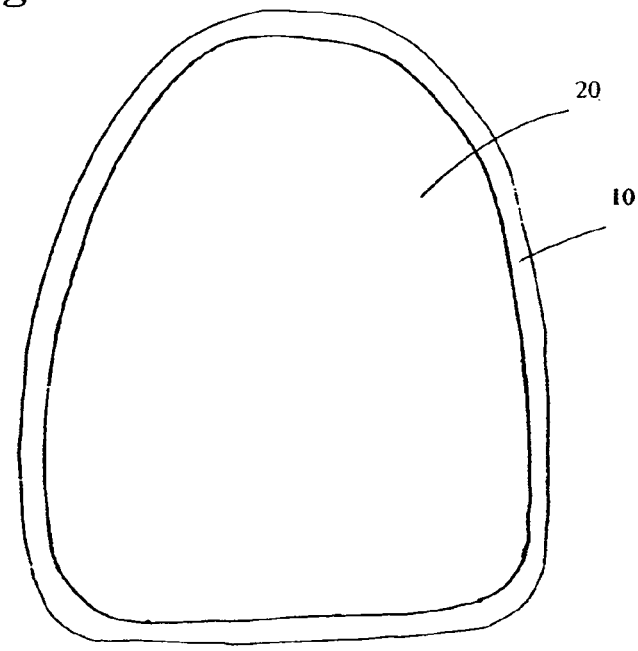
FIG. 2 is top planar view of a toe cap top and bottom insulating structure of the present invention.

The insulation value was increased by the addition of 2 mm thick insulating structures of vacuum packed, fine pore size insulation. The insulation structure consisted of a structure material of NP40 (from Nanopore Inc., Albuquerque, N. Mex.) which comprises fumed silica blended with about 2% by weight of polyester fiber and about 7% by weight of carbon black. The mixture was dried in an oven at about 100° C. for several hours before use. The dried mixture was laid in a flat tray and pressed at a pressure of about 10 psi to form a 2 mm thick board with a density of about 150 kg/m$^3$. The board was cut into two shaped pieces, a shape corresponding to the top side of a toe cap (FIG. 2*b*) and a shape corresponding to the underside (FIG. 2*a*).

Figure 2B:
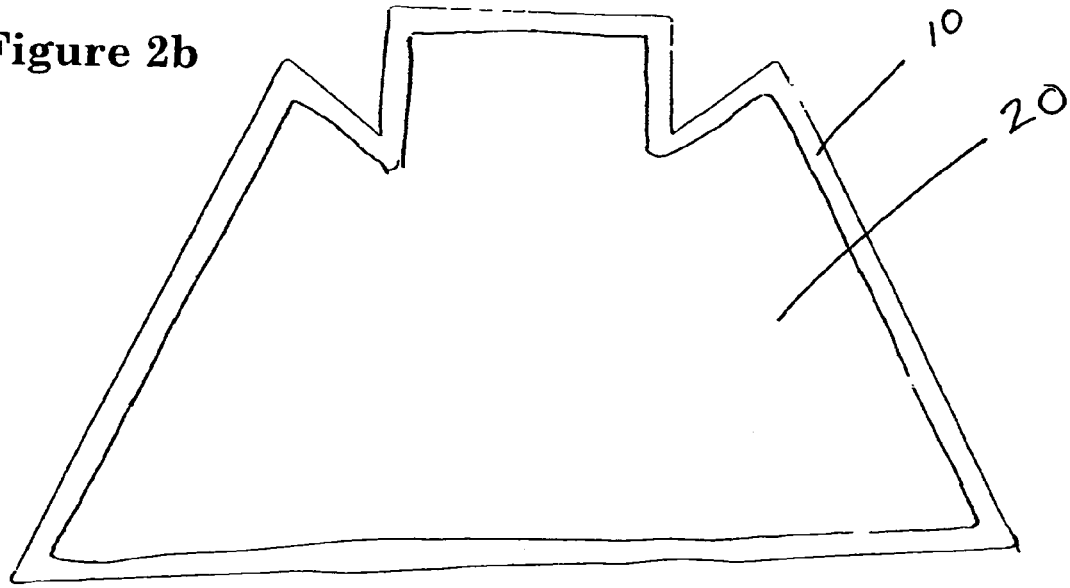

The shaped pieces were vacuum packed at a residual air pressure of about 1,000 Pa in a gas impermeable envelope. The envelope was aluminized polyester which comprised 12 μm polyester with a vacuum-deposited aluminum layer of less than 1 μm thickness, a second polyester layer of about 12 μm thickness, and a heat sealable polyethylene layer of about 30 μm thickness (type 0655/002 from Remax PLC, London, UK). The envelope was sealed in a two step process in which the shaped piece to be enclosed was placed on one layer of polyester film and another layer of film placed on top. The two layers of film were then heat sealed around the majority of the perimeter leaving an unsealed length of about 20 mm (FIGS. 2*a* and 2*b*, at 10). The shapes were then placed in a vacuum chamber and the pressure was reduced to less than 1000 Pa to form insulating structures (FIGS. 2*a* and 2*b*, at 20). The remaining length of the perimeter was then heat-sealed.

Figure 3:
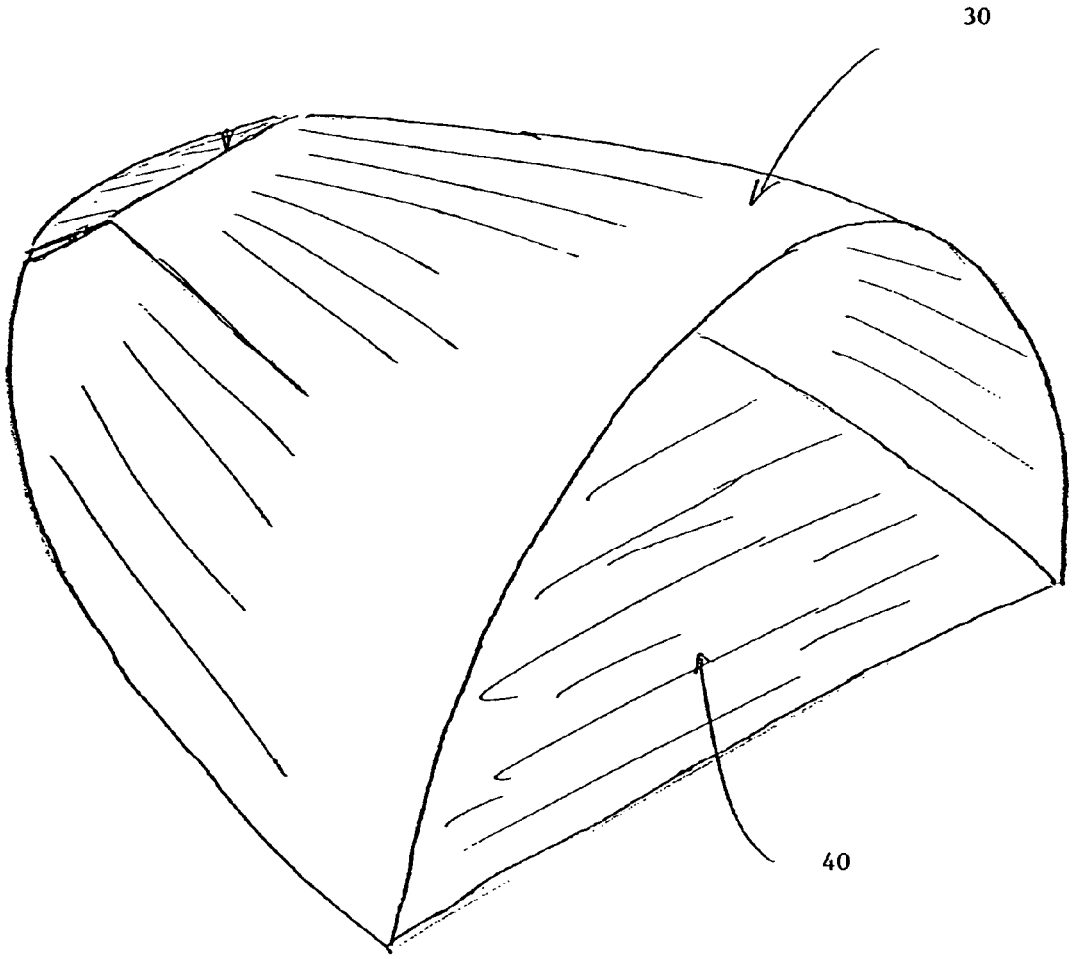
FIG. 3 is a side view of a shaped toe cap insulation structure of the present invention.

Insulating structures were shaped to cover approximately the front 110 mm of the foot. One structure covering the bottom of the front part of the foot, had approximately a semicircular shape with a base of about 90 mm and a height of about 110 mm (FIG. 3 at 40). The other structure covered a portion of the top part of the foot in approximately a rhombic shape with a base of about 180 mm and a height of about 100 mm (FIG. 3 at 30). These were installed between the inner and outer boots of a pair of alpine ski boot. The inner boot was constructed of foam, textile and molded plastic of about 2 to 3 mm thickness in the toe area. The outer boot was constructed of molded plastic and was about 5 mm thick.

The thermal conductivity of the insulating structures was about 6 mW/m K as measured on a heat flow meter thermal conductivity apparatus. The resulting insulation value was about 0.33 m$^2$ K/W. The 2 mm thickness of the insulating structures was not noticeable to the wearer in blinded trials with two test subjects wearing the boots with and without structures on alternate days. The test subjects wore the boots in a climatic chamber at a temperature of about −10° C. while performing a test protocol of about 2 hours duration which consisted of alternately resting and working on a bicycle ergometer. The results of the test subjects' toe temperatures are shown in FIG. 4. As illustrated by the graph, the addition of the insulating structures to the boot resulting in an increase in toe temperature of about 8° C. after about 2 hours of cold exposure.

I claim:

1. A method of insulating a boot comprising providing a boot having a toe cap area, a boot upper and a boot sole;

providing a mixture comprising a porous material selected from fumed metal oxide and aerogel;

compressing the mixture to form a structure material, placing more than one section of the structure material in a gas impermeable envelope, evacuating air from the envelope at reduced pressure, and sealing the envelope, to form a flat insulating structure comprising more than one section of structure material within the envelope;

sealing the envelope between sections of the structure material within the envelope to provide flexibility to the flat insulating structure for shaping;

shaping the flat insulating structure from a flat structure into the form of a shaped insulating structure; and inserting the shaped insulating structure into the boot, the shaped insulating structure having a thermal conductivity of less than or equal to 25 mW/m K at 25° C.

2. The method of claim 1, wherein the boot comprises inner and outer boot layers and the shaped insulating structure is positioned between the layers.

3. The method of claim 1, wherein the shaped insulating structure is affixed to an inner boot layer and adjacent a wearer of the boot.

4. The method of claim 1, wherein the flat insulating structure is shaped into the form of a curved shaped insulating structure that corresponds to the toe cap area of the boot.

5. The method of claim 1, wherein the gas impermeable envelope is under a vacuum pressure of up to about 10,000 Pa.

6. The method of claim 1, wherein the gas impermeable envelope is under a vacuum pressure of about 1,000 Pa or less.

7. The method of claim 1, wherein the method comprises forming the flat insulating structure having a thickness of less than 3 mm.

8. The method of claim 1, wherein the method comprises forming the flat insulating structure having a thickness of 2 mm or less.

9. A method of insulating a boot comprising providing a boot having a toe cap area, a boot upper and a boot sole;

providing a mixture comprising a porous material selected from fumed metal oxide and aerogel;

compressing the mixture to form a structure material, placing more than one section of the structure material in a gas impermeable envelope, evacuating and sealing the envelope at reduced pressure, to form a flat insulating structure comprising more than one section of structure material within the envelope;

sealing the envelope between sections of the structure material within the envelope to provide flexibility to the flat insulating structure for shaping;

shaping the flat insulating structure from a flat insulating structure into a form of a shaped insulating structure; and inserting the shaped insulating structure into the toe cap area of the boot, the shaped insulating structure having a thermal conductivity of less than or equal to 25 mW/m K at 25° C.

10. The method of claim 9, wherein the flat insulating structure has a loss of thickness of 20% or less at a pressure of 1 atmosphere.

11. The method of claim 9, wherein the flat insulating structure has a loss of thickness of 10% or less at a pressure of 1 atmosphere.

12. The method of claim 9, wherein the porous material is a fumed metal oxide.

13. The method of claim 9, wherein the porous material is fumed silica.

14. The method of claim 9, wherein the porous material is fumed alumina.

15. The method of claim 9, wherein the flat insulating structure is shaped into the form of a curved shaped insulating structure that corresponds to the toe cap area of the boot.

16. The method of claim 9, wherein the gas impermeable envelope is under a vacuum pressure of up to about 10,000 Pa.

17. The method of claim 9, wherein the gas impermeable envelope is under a vacuum pressure of about 1,000 Pa or less.

18. The method of claim 9, wherein the boot comprises inner and outer boot layers, and the method further comprises positioning the insulating component between the inner and outer boot layers.

19. The method of claim 9, wherein boot comprises an inner boot layer, and the method further comprises affixing the insulating component to the inner boot layer adjacent a wearer of the boot.

20. The method of claim 9, wherein the method comprises forming the flat insulating structure having a thickness of less than 3 mm.

21. The method of claim 9, wherein the method comprises forming the flat insulating structure having a thickness of 2 mm or less.

* * * * *